US007258108B2

(12) United States Patent
Haraga

(10) Patent No.: US 7,258,108 B2
(45) Date of Patent: Aug. 21, 2007

(54) FUEL INJECTION RAIL

(75) Inventor: Kazuyuki Haraga, Koga (JP)

(73) Assignee: Sanoh Kogyo Kabushiki Kaisha, Koga-Shi (JP)

( * ) Notice: Subject to any disclaimer, the term of this patent is extended or adjusted under 35 U.S.C. 154(b) by 0 days.

(21) Appl. No.: 10/989,213

(22) Filed: Nov. 15, 2004

(65) Prior Publication Data

US 2005/0109324 A1 May 26, 2005

(30) Foreign Application Priority Data

Nov. 20, 2003 (JP) ..... 2003-390456

(51) Int. Cl.
*F02M 37/04* (2006.01)

(52) U.S. Cl. ..... 123/468; 123/467

(58) Field of Classification Search ..... 123/468, 123/469, 470, 472, 456, 467, 514
See application file for complete search history.

(56) References Cited

U.S. PATENT DOCUMENTS 4,474,160 A * 10/1984 Gartner ..... 123/468
4,519,368 A * 5/1985 Hudson, Jr. ..... 123/468
4,649,884 A * 3/1987 Tuckey ..... 123/457
4,660,524 A * 4/1987 Bertsch et al. ..... 123/468
5,024,198 A * 6/1991 Usui ..... 123/468
5,090,385 A 2/1992 Usui et al.
6,374,809 B2 * 4/2002 Satou ..... 123/470
6,666,189 B1 * 12/2003 Hosoya ..... 123/456
6,725,839 B2 * 4/2004 Zdroik et al. ..... 123/456

FOREIGN PATENT DOCUMENTS

JP 2001-132576 5/2000

* cited by examiner

*Primary Examiner*—Carl S. Miller
(74) *Attorney, Agent, or Firm*—Ladas and Parry LLP

(57) ABSTRACT

A fuel injection rail has a rail body formed by joining together a first body member having the shape of a trough and a second body member having the shape of a flat plate. Edges of the side walls of the first and the second body members are joined in folded seams by folding the edges of the first body member so as to crimp the edges of the second body member, and the folded seams are brazed.

7 Claims, 2 Drawing Sheets

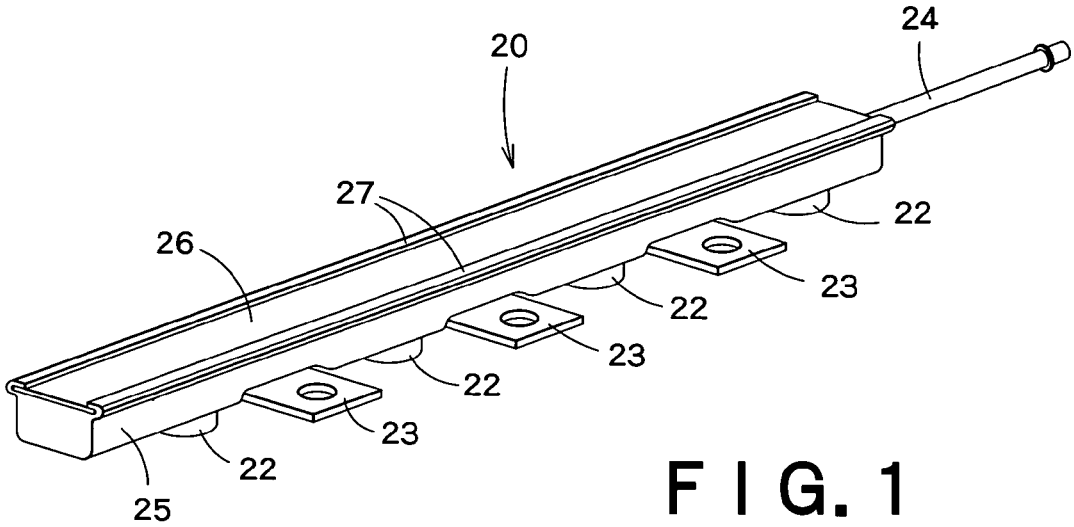
FIG. 1
FIG. 2
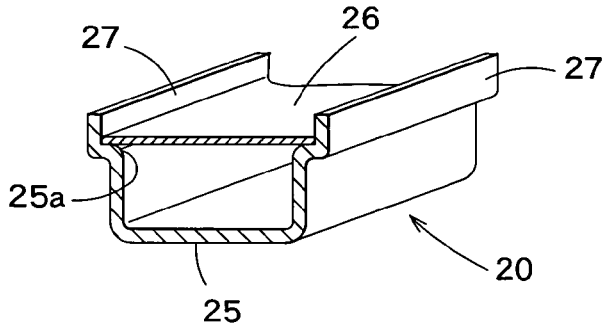
FIG. 3
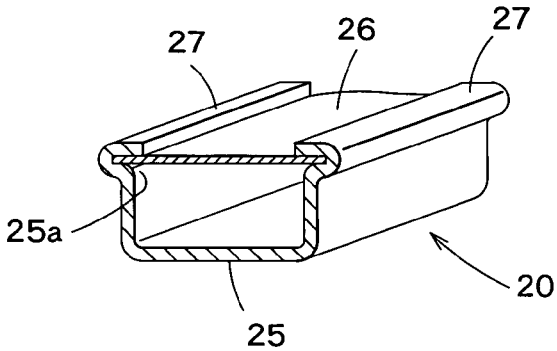
FIG. 4
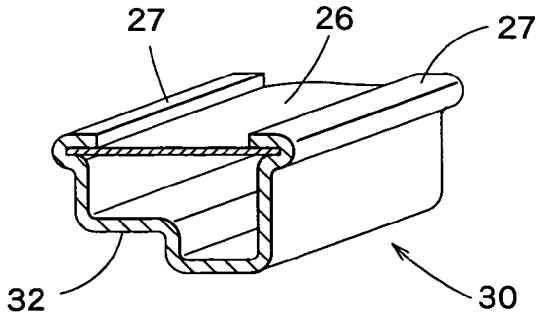

FUEL INJECTION RAIL

BACKGROUND OF THE INVENTION

1. Field of the Invention

The present invention relates to a fuel injection rail employed in a fuel injection system for an automotive engine.

2. Description of the Related Art

In a fuel supply system for supplying fuel to an automotive engine, a fuel supply pump delivers the fuel to send the fuel through a fuel feed line to a fuel injection rail. The fuel injection rail distributes the fuel to injectors attached to the fuel injection rail. The injectors spray the fuel into an intake manifold connected to an engine.

Referring to FIG. 6 showing a conventional fuel injection rail, the fuel injection rail has a rail body 10 consisting of two pan-shaped members having the shape of a pan, namely, an upper pan-shaped member 10*a* and a lower pan-shaped member 10*b*. Injector holding cups 12 are attached to the lower wall of the lower pan-shaped member 10*b*. A fuel inlet pipe 14 is connected to one end of the rail body 10. The upper pan-shaped member 10*a* and the lower pan-shaped member 10*b* are formed by deep draw stamping. The upper pan-shaped member 10*a* and the lower pan-shaped member 10*b* are assembled together and are brazed together by braze furnace the joint thereof.

Problems arise in brazing together the upper pan-shaped member 10*a* and the lower pan-shaped member 10*b* which are formed by deep draw stamping by brazing. It is very difficult to form the upper pan-shaped member 10*a* and the lower pan-shaped member 10*b* accurately in design dimensions by deep draw stamping. Over wrap area of the side walls of the lower pan-shaped member 10*b* are inserted in a space between the side walls of the upper pan-shaped member 10*a* as shown in FIG. 7. It is difficult to form the upper pan-shaped member 10*a* and the lower pan-shaped member 10*b* by deep draw stamping such that a uniform clearance is formed between the over wrap area of the side wall of the lower pan-shaped member 10*b* and the corresponding over wrap area of the side wall of the upper pan-shaped member 10*a*. The quality of brazing the upper pan-shaped member 10*a* and the lower pan-shaped member 10*b* is greatly dependent on the accuracy of the clearance. An irregular clearance increases the possibility of defective brazing. Residual stress remains within the upper pan-shaped member 10*a* and the lower pan-shaped member 10*a* which are formed by a metal deformation process, namely, deep drawing. When the upper pan-shaped member 10*a* and the lower pan-shaped member 10*b* are heated at a high temperature in a braze furnace, the high temperature releases the residual stress and, consequently, a large deformation uncorrectable by a finishing process subsequent to brazing develops in the upper pan-shaped member 10*a* and/or the lower pan-shaped member 10*b*.

It is desirable that the side walls of the rail body of the fuel injection rail are capable of convexly and concavely deforming according to the variation of pressure in the fuel injection rail to lessen the pulsation of the pressure in the fuel injection rail. When the over wrap area of the side walls of the upper pan-shaped member 10*a* and the lower pan-shaped member 10*b* are assembled together and copper brazed together by brazing, the thickness of brazed parts of the side walls of the rail body 10 is doubled and the rigidity of the side walls increases. Such an increase in rigidity of the side walls of the rail body 10 is undesirable for the effective absorption of fuel pressure pulsation.

SUMMARY OF THE INVENTION

Accordingly, it is an object of the present invention to provide a fuel injection rail free from those problems in the conventional fuel injection rail, including a rail body consisting of body members which can be satisfactorily brazed together by brazing without being affected by the dimensional accuracy of the body members, having construction capable of suppressing deformation due to the reduction of residual stress, and capable of suppressing the pulsation of fuel pressure therein.

A fuel injection rail in a first aspect of the present invention for distributing fuel supplied by pressure thereto through a fuel feed line by a fuel delivery system to injectors includes a rail body formed by joining together first and second body members; wherein over wrap area of side walls of the first and the second body members are joined in crimped edges by folding the over wrap areas of either the first or the second body member, and the crimped seams are brazed.

A fuel injection rail in a second aspect of the present invention for distributing fuel supplied by pressure thereto through a fuel feed line by a fuel delivery system to injectors includes a rail body formed by joining together first and second body members; wherein the first body member has the shape of a pan, the second body member has the shape of a flat plate, over wrap area of the side walls of the first body member are crimped so as to crimped edge parts of the second body member to form folded seams, and the folded seams are brazed.

In the fuel injection rail of the present invention, the quality of brazing is not affected by the accuracy of the rail body formed by joining together the first and the second body member, and deformation due to residual stress can be suppressed.

BRIEF DESCRIPTION OF THE DRAWINGS

The above and other objects, features and advantages of the present invention will become more apparent from the following description taken in connection with the accompanying drawings, in which:

FIG. 1 is a perspective view of a fuel injection rail in a first embodiment according to the present invention;

FIG. 2 is a partially sectional perspective view of assistance in explaining a step of a process for forming a rail body included in the fuel injection rail shown in FIG. 1;

FIG. 3 is a partially sectional perspective view of assistance in explaining a step of the process for forming the rail body included in the fuel injection rail shown in FIG. 1;

FIG. 4 is a partially sectional perspective view of a rail body included in a fuel injection rail in a second embodiment according to the present invention;

DESCRIPTION OF THE PREFERRED EMBODIMENTS

Figure 5:
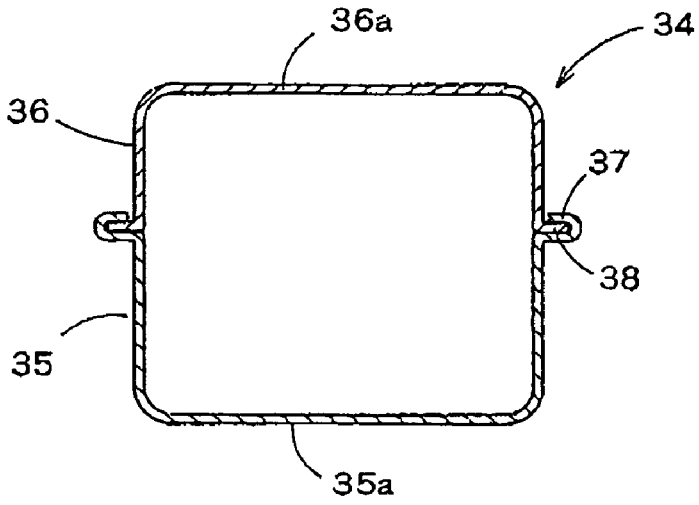
FIG. 5 is a cross-sectional view of a rail body included in a fuel injection rail in a third embodiment according to the present invention.
Figure 6:
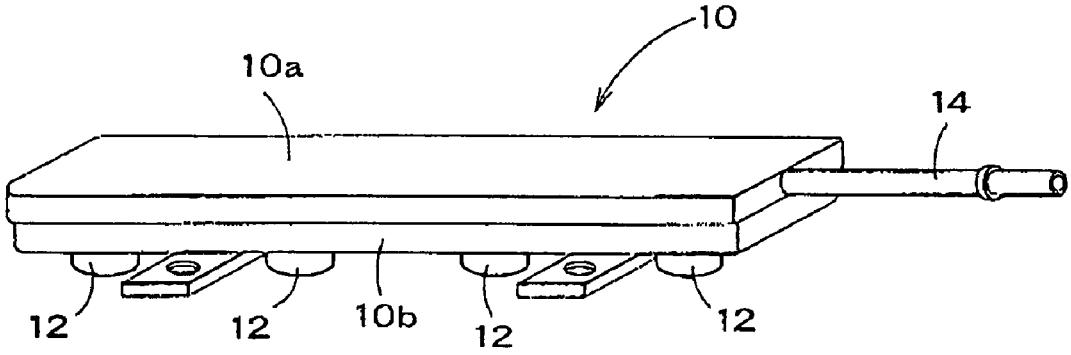
FIG. 6 (PRIOR ART)
FIG. 6 is a perspective view of a conventional fuel injection rail.
Figure 7:
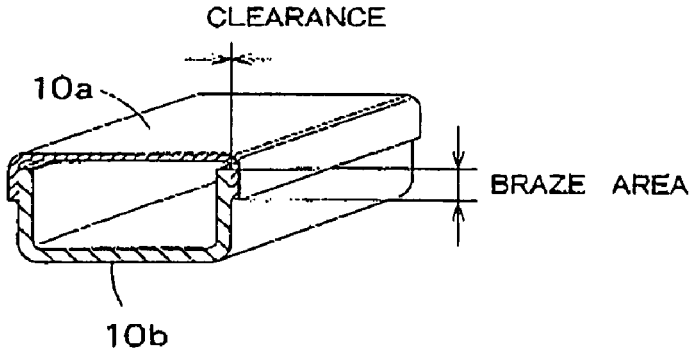
FIG. 7 (PRIOR ART)
FIG. 7 is a partially sectional perspective view of the fuel injection rail shown in FIG. 6.

Referring to FIG. 1 showing a fuel injection rail in a first embodiment according to the present invention, the fuel injection rail has a rail body 20 having the shape of an extruded box, The rail body 20 has a bottom wall provided with fuel supply openings, not shown, respectively corresponding to the cylinders of an engine and longitudinally arranged at predetermined intervals. Injector cups 22 are fitted in the fuel supply openings and are fixed to the bottom wall of the rail body 20. Injectors are assembled to the rail body 20 by pressing the same in the injector cups 22. A fuel inlet pipe 24 is connected to one end of the rail body 20. Brackets 23 for mounting are assembled to the bottom wall of the rail body 20.

Referring to FIG. 2, the rail body 20 having a generally rectangular cross section consists of a pan-shaped first member 5 and a plate-shaped second member 26. The second member 26 forms the top wall of the rail body 20. The first member 25 is formed by subjecting a plate to a deep drawing process or a roll forming process. The first member 25 has the shape of an extruded pan having a U-shaped cross section. The bottom wall, to which the injector cup 22 are assembled, of the first member 25 is parallel either unparallel to the opposite second member 26. Steps 25*a* are formed in upper parts of the side walls of the first member 25, and crimping over wrap areas 27 rise from the steps 25*a*, respectively. The flat second member 26 is seated on the steps 25*a*, and the crimping edge areas 27 are folded to clamp edge parts of the second member 26 firmly by the folded crimping edge parts 27. The injector cups 22 may be assembled to the flat second member 26.

A method of brazing together the first member 25 and the second member 26 of the fuel injection rail will be described. The second member 26 has a width approximately equal to the distance between the inner surfaces of the crimping wall area 27 rising from the steps 25*a* and a length approximately equal to the length of the crimping edge 27. The second member 26 is seated on the steps 25*a* of the first member 25, and then, the second member 26 is fastened to the crimping edge 27 by any suitable fastening method, such as brazing, resistance welding, TIG arc welding or laser welding. If the second member 26 is forced in a space between the crimping edges 27 by pressure and pressed against the steps 25*a*, the second member 26 does not need necessarily to be welded to the first member 25. Subsequently, the crimping edges 27 rising from the steps 25*a* of the first member 25 are bent inward so as to crimp the edges of the second member 26 firmly as shown in FIG. 3 such that the second member 26 is fastened to the first member 25. The injector cups 22, the brackets 23 and the fuel supply pipe 24 are assembled to the rail body 20 by resistance welding, a brazing filler material is placed at the joints of those members, and the temporary assembly of those members is heated up by braze furnace.

Residual stress, i.e., stress induced in the first member 25 by plastic deformation in the deep drawing process, remains in the first member 25. When the temporary assembly is heated at a high temperature in the furnace, the residual stress is relieved and the first member 25 tends to deform. Since the side walls of the first member 25 are able to move sideways without being restrained by the second member 26, the stress can be relieved and the deformation of the first member 25 is suppressed. Since the crimping edges 27 are folded to fasten the second member 26 to the first member 25, maintain clearances necessary for brazing can be formed regardless of the dimensional accuracy of the first member 25. Therefore any problems relating to the quality of brazing dependent on the accuracy of clearances do not arise and uniform brazing can be achieved.

Use of O rings and sealing members may be effective in forming liquid-seal joints. However, use of O rings and sealing members is not preferable because O rings and sealing members are permeable to fuel. In the fuel injection rail of the present invention, the crimping edges 27 are folded and brazed to the edge parts of the second member 26, so that the first member 25 and the second member 26 are joined together by liquid-tight joints that do not allow fuel permeation.

Since the second member 26 can be formed simply by cutting a plate in a predetermined size, any cost of a die for forming the second member 26 is not necessary. The second member 26 may be formed by cutting a plate of a thickness smaller than that of a plate for forming the first member 25 to improve the pulsation absorbing ability of the rail body 20. Thus, the fuel injection rail of the present invention has a high flexibility of freedom of design to meet a required pulsation absorbing ability.

Referring to FIG. 4 showing a fuel injection rail in a second embodiment according to the present invention, a rail body 30 consists of a first member 32 having a substantially L-shaped cross section and a flat second member 26. The first member 32 is formed by bending press work. Crimping edges 27 of the side walls of the first member 32 are folded to crimp edges of the second member 26 firmly. Joints of the first member 32 and the second member 26 are bonded by brazing by a method similar to that performed in fabricating the fuel injection rail in the first embodiment. Thus, the rail body 30 of the fuel injection rail can be formed any suitable shape having any suitable cross section, such as a rectangular cross section or a stepped rectangular cross section so as to meet requirements, such as a required pulsation absorbing ability.

Referring to FIG. 5 showing a fuel injection rail in a third embodiment according to the present invention, a rail body 34 consists of a lower member 35 and an upper member 36. The lower member 35 and the upper member 36 are formed by deep draw stamping and each has the shape of an extruded pan having a U-shaped cross section. The lower member 35 has side walls provided with longitudinal flanges 37, respectively. The flanges 37 are crimping flanges to be folded for crimping. The upper member 36 has side walls provided with longitudinal flanges 38, respectively. The flanges 38 of the upper member 36 have a width smaller than that of the flanges 37 of the lower member 35. Injector cups 22 are assembled to the bottom wall 35*a* of the lower member 35 as shown in FIG. 1. The upper member 36 has a top wall opposed parallel to the bottom wall 35*a* of the lower member 35.

The lower member 35 and the upper member 36 are combined so that the flanges 37 and 38 are crimping together, the flanges 37 are folded to form folded seams, and the folded seams are brazed to join together the lower member 35 and the upper member 36. The flanges 38 may be formed in a width wider than that of the flanges 37, and the flanges 38 may be folded to form folded seams.

Residual stress, i.e., stress induced in the lower member 35 and the upper member 36 by plastic deformation in the deep drawing process, remains in the lower member 35 and the upper member 35. When the assembly of the lower member 35 and the upper member 36 is heated at a high temperature for brazing in the furnace, the residual stress is relieved and the lower member 35 and the upper member 36 tend to deform. Since the respective flanges 37 and 38 of the lower member 35 and the upper member 36 are able to move sideways relative to each other without being restrained by each other, the stress can be relieved and the deformation of the lower member 35 and the upper member 36 is suppressed. Since the folded seams formed by crimping and brazing the flanges 37 and 38 do not increase the thickness and rigidity of the side walls of the rail body 34 and hence do not deteriorate the pulsation absorbing ability of the rail body 34.

Although the invention has been described in its preferred embodiment with a certain flexibility of particularity, obviously many changes and variations are possible therein. It is therefore to be understood that the present invention may be practiced otherwise than as specifically described herein without departing from the scope and spirit thereof.

What is claimed is:

1. A fuel injection rail for distributing fuel supplied by pressure thereto through a fuel feed line by a fuel delivery system to injectors, said fuel injection rail comprising a rail body formed by joining together first and second body members;

wherein the first body member has the shape of an extruded pan in the shape of a trough of U-shape having a bottom and upstanding side walls, the second body member has the shape of a flat plate and has a thickness smaller than that of the first body member to thereby allow the plate to absorb pressure pulses to a greater extent than the first member, said side walls of the first body member having edges folded over edges of said second body member so as to crimp said edges of the second body member to form folded seams, the folded seams being brazed, and injector cups assembled to said bottom of the first body member; wherein the first body member is formed in the shape of the trough by bending and said bottom of the through has a stepped bottom wall, wherein said trough shape of said first body member has an open top, said edges of said side walls each being formed with an outward bend to form steps on which a lower surface of said edges of said flat plate of said second body member are supported, said edges of said side walls being bent over an upper surface of said flat plate and thereby crimp said edges of the second body member, wherein the crimped edges of the flat plate, form, when brazed with the trough, seams constituting the sole connections between the first and second body members.

2. The fuel injection rail according to claim 1, wherein the first body member is formed in the shape of an extruded pan by deep draw stamping.

3. The fuel injection rail according to claim 1, wherein the second body member is opposed to the bottom wall of the first body member.

4. The fuel injection rail according to claim 1, wherein the second body member having the shape of a flat plate is welded to the first body member having the shape of a trough before folding the edges of the side walls of the first body member so as to crimp the edges of the second body member.

5. The fuel injection rail according to claim 1 wherein said edges of the side walls of the trough being upper edges of said trough which are folded around the edges of the plate member to crimp said edges thereat.

6. The fuel injection rail according to claim 1, wherein said flat plate is cut from a larger plate and has a thickness less than the thickness of said extruded pan.

7. The fuel injection rail according to claim 1, wherein said first body develops residual stresses when it is extruded to form said U-shape, said side walls of the U-shaped body being free to deform at brazing temperature to relieve the residual stress.

* * * * *